United States Patent [19]

Kim

[11] Patent Number: 4,932,506

[45] Date of Patent: Jun. 12, 1990

[54] COVER FOR A CARRYING CASE

[75] Inventor: Hyun S. Kim, New Castle, Pa.

[73] Assignee: Airway Industries, Inc., Ellwood City, Pa.

[21] Appl. No.: 309,434

[22] Filed: Feb. 10, 1989

Related U.S. Application Data

[63] Continuation-in-part of Ser. No. 258,337, Oct. 17, 1988.

[51] Int. Cl.[5] ..... A45C 3/00; A45C 13/00; A45C 13/36

[52] U.S. Cl. ..... 190/111; 190/112; 190/119; 190/125; 190/126; 190/127; 150/128; 150/130; 383/107

[58] Field of Search ..... 190/110–112, 190/103, 124, 126, 127, 125, 119; D3/71, 76; 383/2, 107, 120; 150/127, 128, 130

[56] References Cited

U.S. PATENT DOCUMENTS

| | | | |
|---|---|---|---|
| D. 225,134 | 11/1972 | Bialo | D3/71 |
| D. 226,879 | 5/1973 | Tweedie | D3/76 |
| D. 270,112 | 8/1983 | Stark | D3/71 |
| 2,964,149 | 12/1960 | Smallberg | 190/111 |
| 3,291,267 | 12/1966 | Pelavin | 190/111 |
| 3,443,671 | 5/1969 | Dyke | 190/110 |
| 3,447,649 | 6/1969 | Kish, Jr. | 190/127 X |
| 3,477,553 | 11/1969 | Kish, Jr. | 190/124 X |
| 3,741,355 | 6/1973 | Slan | 190/124 |
| 4,729,460 | 3/1988 | Kim | 190/111 X |

FOREIGN PATENT DOCUMENTS

| | | | |
|---|---|---|---|
| 2632589 | 1/1978 | Fed. Rep. of Germany | 190/103 |

*Primary Examiner*—Sue A. Weaver
*Attorney, Agent, or Firm*—Walter J. Blenko, Jr.; Suzanne Kikel

[57] ABSTRACT

A cover for the front and/or the back of a carrying case with a semi-rigid frame, and comprising a lining and an outer panel. The outer panel has a main central portion and a gusset member around the periphery of the central portion which are connected together through an inner welt, and which are spaced apart by a reinforcement member located in each of the four corners of the outer panel. The lining and outer panel are connected together through an outer welt around the outer peripheral edge of the cover. This second welt is concentric with the first welt, the construction of the cover being such that the outer panel is in a dome-shaped configuration for a unique appearance and additional content holding capacity for the compartments of the case.

30 Claims, 3 Drawing Sheets

COVER FOR A CARRYING CASE

This is a continuation-in-part of a co-pending design patent application Ser. No. 258,337 filed on Oct. 17, 1988.

This invention relates to a cover for the front and back of a carrying case, such as a luggage case, brief case, tote bag, school bag, etc., and has particular relation to a cover having a dome shaped construction extending outwardly from the body of the case. More particularly, the invention relates to a case which has a soft cover while retaining the appearance of a hard cover.

Hard and/or soft cover cases are well-known in the art. In the construction of a soft cover, the cover commonly has an outer wall with one or more sheets of material coextensive with the dimension of the cover, and the edges of which are joined together by a welt. The material may be relatively hard or flexible, and may generally be flat.

In the construction of a hard, molded type cover, the cover commonly has an outer wall made of a single layer of material which is a molded piece. This cover may be formed along its outer edge such as to give depth to the front cover for added carrying capacity.

One of the main advantages of the soft cover type of construction for a carrying case is its lightness, while a main advantage of the hard cover type of construction for a case is that it retains its shape thereby preventing the contents from being crushed.

The invention possesses the sales appeal for the hard cover type of construction while retaining the advantages of a soft cover case.

I provide a cover for the front and/or the back of a carrying case of a "soft" type of construction which gives the appearance of a molded type construction. Such a cover is of a simple, inexpensive, and yet lightweight construction. I further provide a cover for a carrying case which has a generally rigid framework and flexible material secured thereto which provide tenuous material surfaces. I further provide a cover for a carrying case which features a dome-shaped panel which is tapered to give a unique appearance to the case, and to provide extra carrying capacity to the compartment or compartments of the case.

More specifically, I provide a cover for the front and/or the back of a carrying case comprising a lining or backing sheet, and an outer panel of material. This outer panel preferably consists of a center piece of material and an outer peripheral piece of material or gusset member. The backing sheet and outer panel are joined together by an outer welt. The center piece of material and the gusset member of the outer panel are joined together by an inner welt. The outer welt is concentric to and outwardly from the inner welt of the panel. A reinforcement piece is disposed along the gusset member in each of the four corners of the outer panel between the first and second welt as to push the panel outwardly away from the body of the case with the gusset member being slightly curved or tapered to give depth to the cover.

The above-described and other details of the present invention will become apparent in the description of a preferred embodiment hereinafter fully set forth when read in connection with the accompanying drawings herein.

Referring to FIGS. 1–6, there is shown a luggage case 10, which is of a light-weight construction comprising a main body portion 12, a hinged front cover 14, and a hinged back cover 16.

Figure 2:
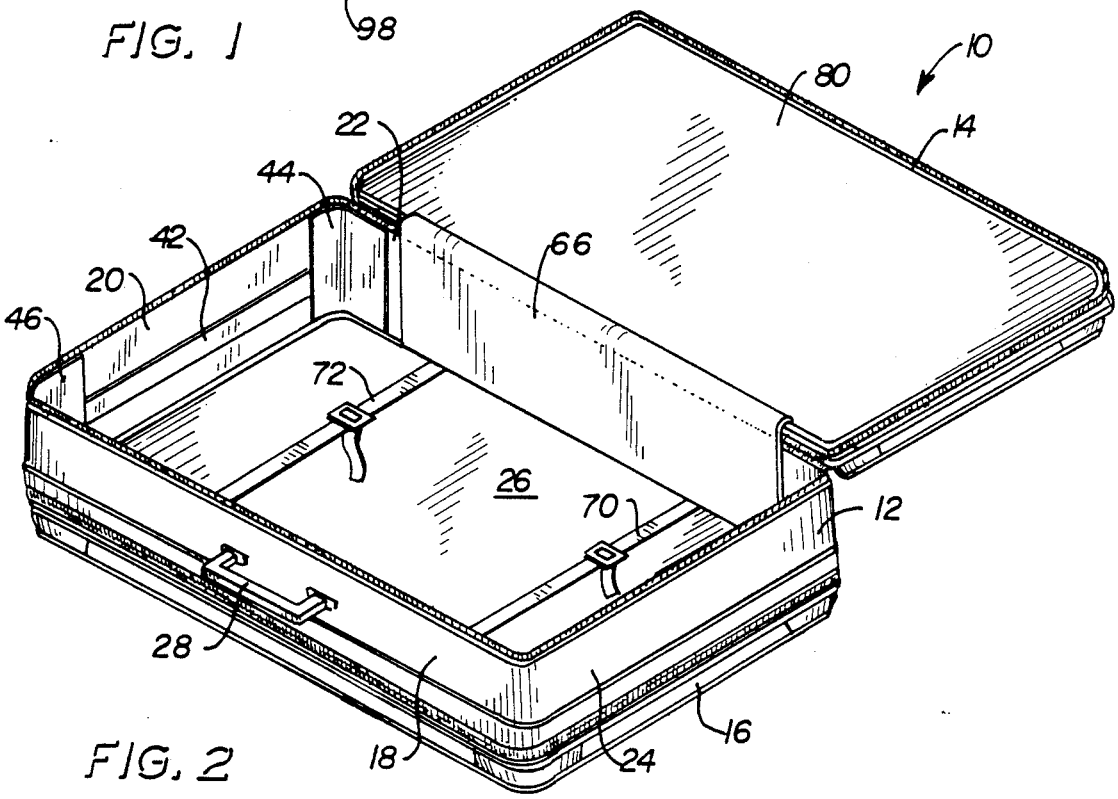
FIG. 2 is a perspective view of the luggage case of FIG. 1 with its front cover opened to expose a main compartment thereof.
Figure 3:
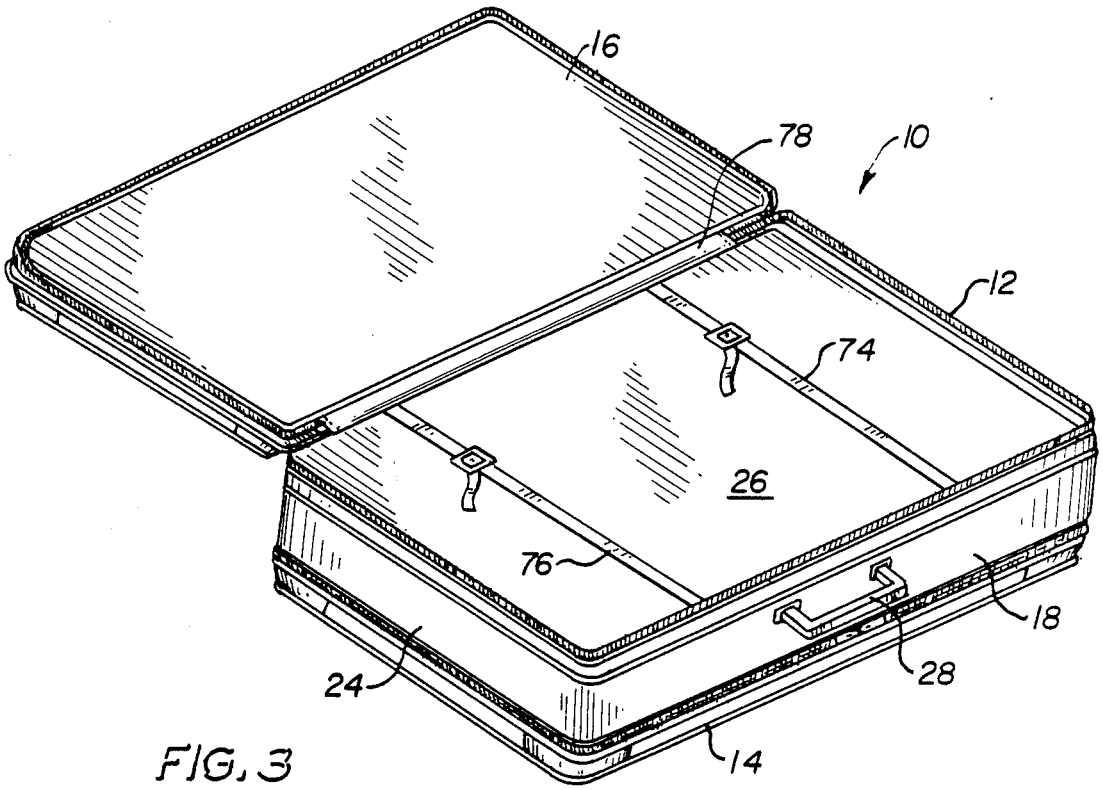
FIG. 3 is a perspective view of the luggage case of FIG. 1 with its back cover opened to expose a sub-compartment thereof.

As particularly shown in FIGS. 2 and 3, the main body portion 12 consists of side walls 18, 20, 22, and 24, and dividing wall 26 which is at the bottom in FIG. 2 and which form a main compartment (FIG. 2) and a sub-compartment (FIG. 3) for case 10. Side walls 18, 20, 22, and 24 are of a sturdy, flexible material such as canvas, cloth, fiber, plastic or vinyl.

Access into the main compartment of FIG. 2 is done by opening of front cover 14 and access into the sub-compartment of FIG. 3 is done by opening of back cover 16. Side walls 18–24 are part of a supporting frame for luggage case 10. A handle assembly 28 is affixed by suitable means (not shown) to the top wall 18 of body portion 12.

Referring again to FIG. 1, a slide fastener 30 on front cover 14 with tabs 32 and 34 is provided for opening and closing the main compartment of case 10. Sliding of tabs 32 and 34 in an opposite direction relative to each other accomplishes the opening and closing of the main compartment by front cover 14. One side of slide fastener 30 is attached preferably by stitches to body portion 12 and its cooperative side is attached by stitches to front cover 14.

Slide fastener 36 on back cover 16 with tabs 38, 40 (FIG. 1) is provided for opening and closing the sub-compartment (FIG. 3) which is adjacent to and separated from the main compartment of luggage case 10 by dividing wall 26.

Figure 4:
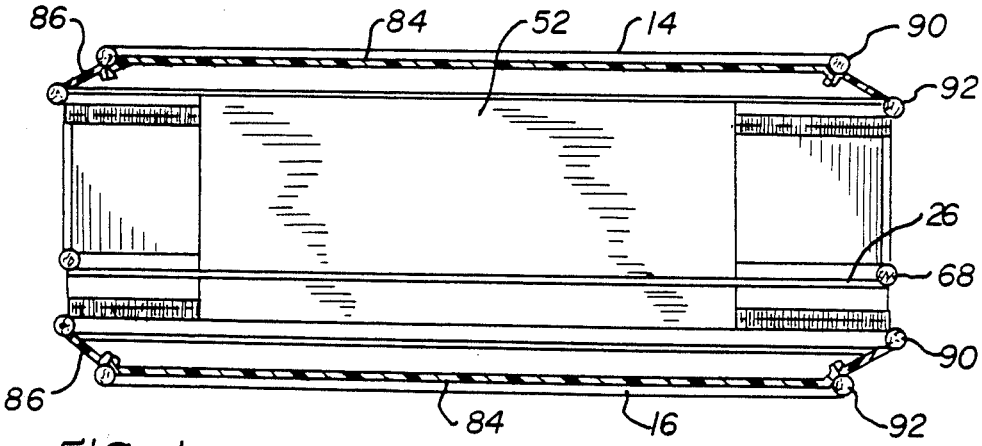
FIG. 4 is a sectional view taken along lines 4—4 in FIG. 1.
Figure 5:
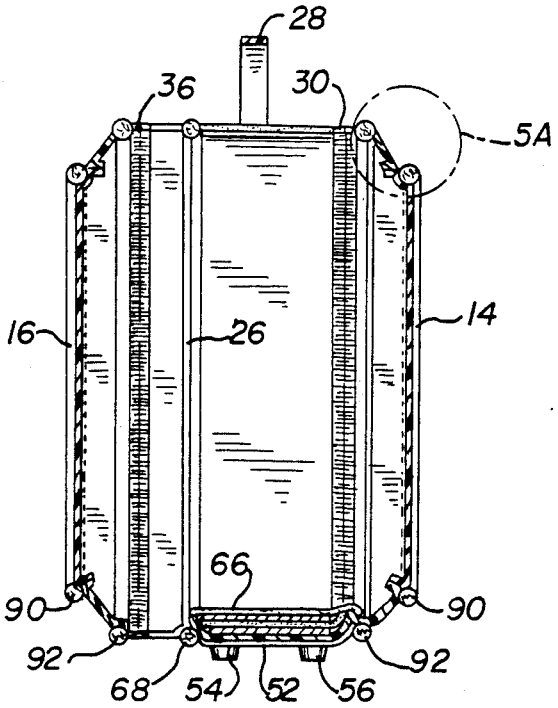
FIG. 5 is a sectional view taken along lines 5—5 in FIG. 1.

FIGS. 2, 4, and 5 in particular show the inside of the main compartment of luggage case 10. A reinforcing strip element 42 shown only to the left of FIG. 2 for clarity extends around the periphery on the inside of the main compartment of body portion 12 adjacent to side walls 18, 20, 22, and 24. Strip element 42 is of a rigid, lightweight material, such as stainless steel or aluminum, and gives support to side walls 18–24, thereby acting as a framework for luggage case 10. Even though not shown, material such as plastic or vinyl is wrapped around reinforcing strip 42 to give it an appearance similar to that of the interior of body portion 12.

Further rigidity is given to side walls 18–24 of luggage case 10 by a brace member located at each of the four corners of body portion 12. For clarity, only two brace members are shown at 44 and 46 to the left of FIG. 2. These brace members extend the width of side walls 18–24, are located beneath and retained by strip element 42, and are of a rigid, durable material, such as plastic.

Figure 6:
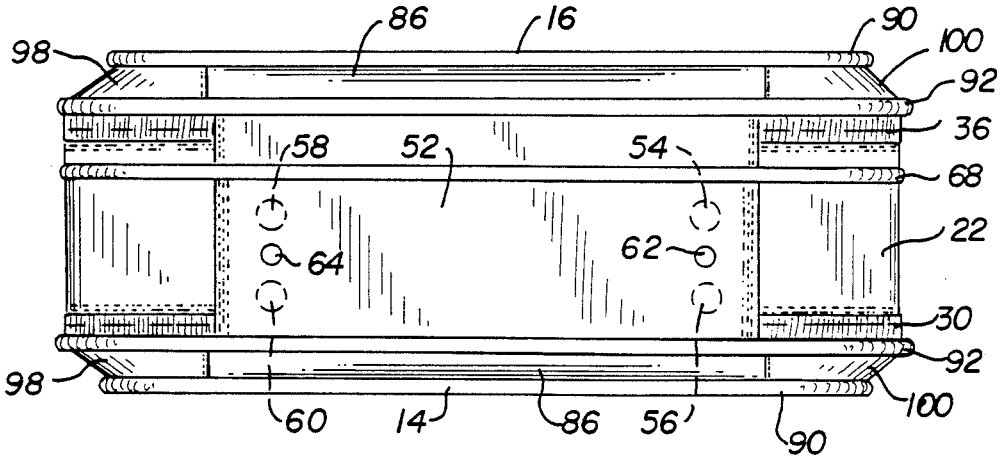
FIG. 6 is a bottom elevational view of the luggage case of FIG. 1.

Referring particularly to FIG. 6, strip element 42 (not shown) and the material comprising side walls 18–24 extend down to and along the bottom wall 22 a distance where they are fastened through suitable means to rigid base assembly 52. Base assembly 52 provides a support which through conventional means, pedestals 54, 56, 58, and 60 (FIG. 6) are attached.

As particularly shown in FIG. 5, base assembly 52 is comprised of several layers of material. The outer layers are preferably made of a durable, flexible material such as cloth, fiber, plastic or vinyl. The inner layers are preferably made of a hard material such as cardboard or plastic. Base assembly 52 is secured to body portion 12 by rivets 62 and 64 (FIG. 6) which even though not shown extend through strip element 42. Slide fasteners 30 and 36 terminate on the opposite ends of base assembly 52 as shown in FIG. 6.

The innermost layer of base assembly 52 indicated at 66 in FIGS. 2 and 5 is a hinge for front cover 14.

Referring particularly to FIGS. 2, 4, and 5, dividing wall 26 of luggage case 10 consists of a one piece, single layer of material stretched to extend the height and length of luggage case 10. Dividing wall 26 is affixed to the material of side walls 18–24 by a welt 68. The welting process for welt 68 is well-known in the luggage industry, involving a rigid wire base and a folding and stitching of the several materials which are to be connected together. Garment holding belts 70 and 72 in the main compartment of luggage case 10 extend across dividing wall 26 from the bottom of side wall 22 to the top of side wall 18, and are included in welt 68 for their securement. FIGS. 4, 5, and in particular show welt 68.

Referring again to FIG. 3, the inside of the sub-compartment of luggage case 10 is shown. This sub-compartment is partially formed by back cover 16, and has access therein by slide fastener 36. The content holding portion of this sub-compartment is formed by dividing wall 26 and side walls 18, 20, 22 and 24 which extend a distance, preferably an inch or more away from welt 68. One side of slide fastener 36 is attached preferably by stitches to the peripheral edge of the material constituting side walls 18–24; and the cooperative side of slide fastener 36 is attached to back cover 16.

Garment holding belts 74 and 76 extend across dividing wall 26 from the bottom of side wall 22 to the top of side wall 18, and are included in welt 68 for their securement (FIG. 3). A piece of flexible, durable material 78, preferably being the same as that for dividing wall 26 is used as a hinge for back cover 16, and is also included in welt 68 for securement (FIG. 3).

Until now body portion 12, which may be of a well-known construction in the luggage industry, has been explained. The essence of the invention involves both the construction for front cover 14 and the construction for back cover 16, which construction is the same and which will now be explained with reference to FIGS. 1 through 6.

Figure 1:
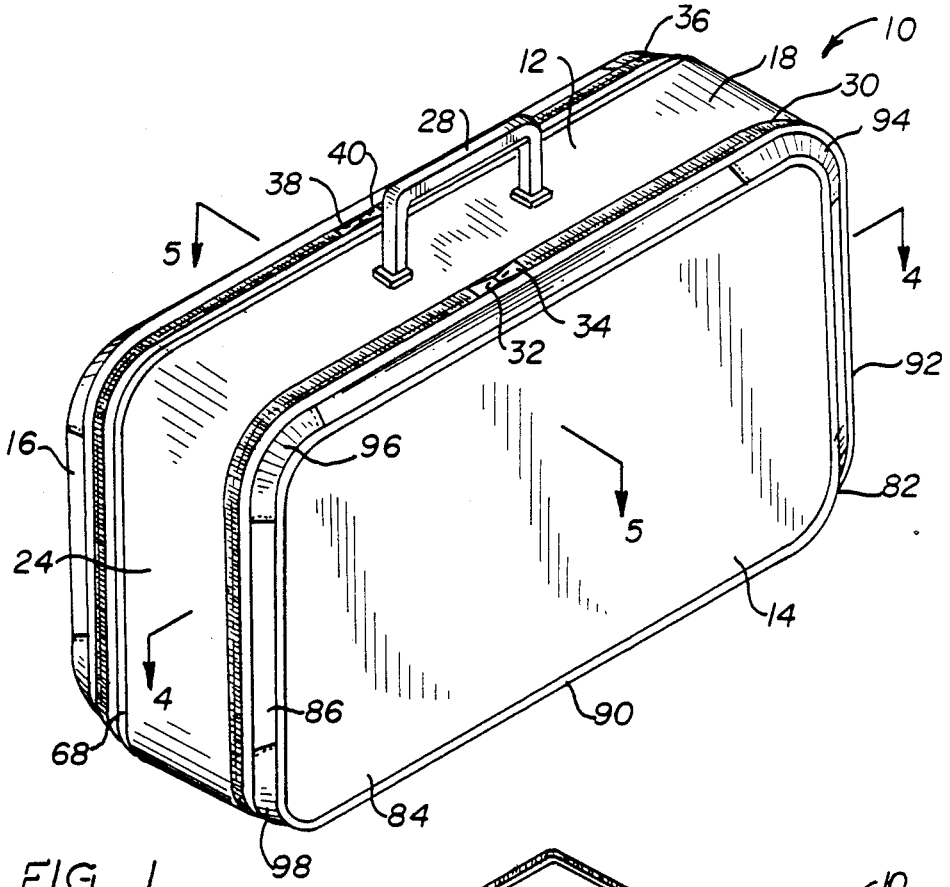
FIG. 1 is a perspective view of an embodiment of the present invention showing a luggage case in a closed positioning.

Front cover 14 consists of two main layers of material. These layers are backing or lining sheet 80 (FIG. 2) and an outer panel which is indicated in FIG. 1 at 82. Preferably, the material for the backing sheet 80 is lighter in weight than the material for outer panel 82. For clarity, backing sheet 80 is only shown in FIG. 2. The material for outer panel 82 preferably is the same as that which constitutes walls 18, 20, 22, and 24.

Outer panel 82 has a central portion 84 and a gusset member 86 as particularly shown in FIG. 1. Gusset member 86 preferably is a one piece strip-like member which extends entirely around central portion 84, and whose ends are connected together preferably by stitches not shown.

Figure 5A:
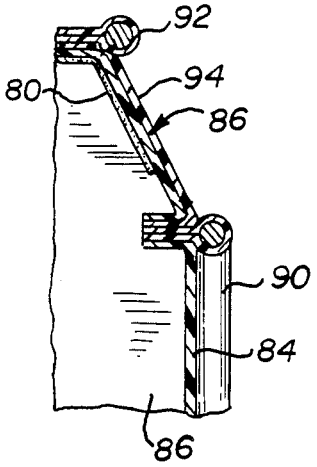
FIG. 5A is an exploded view as shown in FIG. 5.

Gusset member 86 is connected to central portion 84 by welt 90, which as best shown in FIG. 1 extends around the entire outer periphery of central portion 84. The manner in which this is done is best shown in the exploded view of FIG. 5A, where an inner peripheral edge of gusset member 86 is joined to the outer peripheral edge of central portion 84 by welt 90. In doing this, gusset member 86 is caused to extend outwardly in a tapering manner to give a depth dimension to cover 14. To finish off cover 14, both backing sheet 80 and the outer peripheral edge of gusset member 86 are sewn into welt 92.

Even though not entirely shown in any one figure, welt 92 extends around the entire outer peripheral edge of gusset member 86, and is arranged concentrically outwardly relative to welt 90 (FIG. 1). Preferably, welts 90 and 92 contain a rigid wire preferably of spring steel to form a relatively rigid frame structure for cover 14. Preferably, each welt 68, 90 and 92 has an outer sturdy piece of material such as leather, vinyl or plastic.

As shown particularly in FIG. 1, cover 14 is generally rectangular with rounded corners. In order to give support and to space and dispose welt 90 away from welt 92, a reinforcement member is disposed in each of the four corners of cover 14 on the outside of gusset member 86. Reinforcement members 94, 96, and 98 are best shown in FIG. 1, and reinforcement member 100 as well as member 98 are best shown in FIG. 6. These corner members 94, 96, 98, and 100 are placed along and against the outside of gusset member 86 and preferably are made of plastic, vinyl or heavy cloth. Members 94, 96, 98 and 100 are curved and dimensioned to neatly fit along gusset member 86, in each of the four corners of cover 14.

Preferably, members 94, 96, 98, and 100 are of a sturdy flexible material such as leather, vinyl, or plastic and is the same material as the outer covering of welts 68, 90, and 92. Members 94–100 are held in place preferably by stitches (not shown) extending between welts 90 and 92, and are included in these welts 90 and 92.

The width of gusset member 86 is such that when sewn into welts 90 and 92, gusset member 86 measures approximately one inch. Both gusset member 86 and central portion 84 of cover 14 are the same type of skin material, preferably, a laminated leather or textured plastic material.

Backing sheet 80 will preferably be of a light weight plastic, vinyl, or satin. As stated hereinabove, the outer material for welts 68, 90 and 92 preferably will be the same as that for outer members 94, 96, 98, and 100.

In constructing cover 14, central portion 84 is sized and cut, as is gusset member 86. The corner members 94, 96, 98, and 100 are sewn onto the outer surface of gusset member 86. Welting 90 is then sewn along the outer peripheral edge of central portion 84 and the inner peripheral edge of gusset member 86 to create a dome-like panel for cover 14 where gusset member 86 extends outwardly away from central portion 84 approximately one inch. Welt 92 is sewn along the outer peripheral edge of gusset member 86 and includes backing sheet 80 and the one side of slide fastener 30. Backing sheet 80 is such that it lies nicely against the inside surface of panel 82 and follows the same contour as panel 82 to allow cover 14 to give added carrying capacity to the main compartment of luggage case 10.

Back cover 16 is constructed similarly to front cover 14, and similar components are given the same numbers as that for cover 14. For brevity, only some of the components of cover 16 are numbered. Back cover 16 gives added capacity to the sub-compartment of luggage case 10.

Even though both a front cover 14 and a back cover 16 of the invention have been described with reference to a luggage case, it will be appreciated that there may only be one such cover for accommodating a variety of carrying cases. Also, even though the slide fasteners 30, 36 are shown to be a zipper, other slide fasteners can easily be used.

The gusset member 86 and the central portion 84 of cover 14 have been described as being two separate pieces. It will be appreciated that the outer panel of cover 14 can be a piece construction instead of the two pieces. Also, gusset member 86 can be comprised of several pieces of material sewn together.

While I have illustratively shown a preferred embodiment of my invention, it will be apparent that variations therein are possible and no limitations are intended except such as are defined in the following claims.

I claim:

1. A luggage case having front and back ends, and a cover at least attached to said front end, said cover comprising:

an outer material panel means being substantially coextensive with said cover, said outer panel means including a center section having an outer peripheral edge; and gusset means having an outer peripheral edge and an inner peripheral edge and arranged around said center section, and first welt means disposed around said center section and connecting said outer peripheral edge of said center section and said inner peripheral edge of said gusset means together to form said panel means of said cover, and second welt means including said outer peripheral edge of said gusset means and concentrically arranged relative to and outwardly from said first welt means and cooperating with said first welt means to form a framework for said panel means, said outer panel means of said cover further comprising reinforcement means disposed along said gusset means between said first welt means and said second welt means to space and maintain said first welt means and said second welt means apart relative to each other and to cooperate with said first welt means and said second welt means to add rigidity to said panel means of said cover, and said reinforcement means being included in said first welt means and in said second welt means.

2. A luggage case according to claim 1, wherein said cover further comprises a sheet of lining material which is substantially coextensive with said cover and said panel means, and which has an outer peripheral edge connected to said second welt means.

3. A luggage case according to claim 1, wherein said cover is generally a rectangular configuration with corners, and said reinforcement means is located along each said corner of said panel means.

4. A luggage case according to claim 1, wherein said panel means is in a dome configuration with said center section being relatively flat and protruding in an outwardly fashion away from said second welt means, and with said gusset means being in a relatively tapered fashion and extending outwardly from said second welt means to said first welt means and said center section.

5. A luggage case according to claim 1, wherein said material of said center section and said gusset means consists of a durable, flexible textured material, and wherein said material of said center section is of the same type of material as said material of said gusset means.

6. A luggage case having front and back ends, and a cover at least attached to said front end, said cover comprising:

an outer material panel means being substantially coextensive with said cover, said outer panel means including a center section having an outer peripheral edge, and gusset means having an outer peripheral edge and an inner peripheral edge and arranged around said center section, and first welt means disposed around said center section and connecting said outer peripheral edge of said center section and said inner peripheral edge of said gusset means together to form said panel means of said cover, and second welt means including said outer peripheral edge of said gusset means and concentrically arranged relative to and outwardly from said first welt means and cooperating with said first welt means to form a framework for said panel means, said outer panel means of said cover further comprising reinforcement means disposed along said gusset means between said first welt means and said second welt means to space and maintain said first welt means and said second welt means apart relative to each other and to cooperate with said first welt means and said second welt means to add rigidity to said panel means of said cover, said cover being generally in a rectangular configuration with corners, and said reinforcement means being located along each said corner of said panel means, and said reinforcement means consisting of a plurality of pieces of material, each said piece of material being located on an outer surface of said gusset means along one of said each corner of said panel means.

7. A luggage case according to claim 6, wherein said first welt means and said second welt means each has an inner wire and an outer material covering, and wherein said material covering of said first and second welt means is of the same type of material as said material of said reinforcement means.

8. A luggage case according to claim 6, wherein said cover further comprises a sheet of lining material which is substantially coextensive with said cover and said panel means, and which has an outer peripheral edge connected to said second welt means.

9. A luggage case according to claim 6, wherein said panel means is in a dome configuration with said center section being relatively flat and protruding in an outwardly fashion away from said second welt means, and with said gusset means being in a relatively tapered fashion and extending outwardly from said second welt means to said first welt means and said center section.

10. A luggage case according to claim 6, wherein said material of said center section and said gusset means consists of a durable, flexible textured material, and wherein said material of said center section is of the same type of material as said material of said gusset means.

11. A luggage case having front and back ends, and a front cover and a back cover attached to said front and back ends, respectively, said front and back cover each comprising:

an outer material panel means being substantially coextensive with said cover, said outer panel means including a center section having an outer peripheral edge, and gusset means having an outer peripheral edge and an inner peripheral edge and arranged around said center section, and first welt means disposed around said center section and connecting said outer peripheral edge of said center section and said inner peripheral edge of said gusset means together to form said panel means of said cover, and second welt means including said outer peripheral edge of said gusset means and concentrically arranged relative to and outwardly from said first welt means and cooperating with said first welt means to form a framework for said panel means, and said case further comprising a body portion having side walls and a dividing wall in said sidewalls to form a main compartment and a sub-compartment adjacent to said main compartment, and wherein said front cover is a part of and provides access to said main compartment, and said back cover is a part of and provides access to said sub-compartment.

12. A luggage case according to claim 11, wherein said center section of said panel means of said front cover and said center section of said panel means of said back cover are extended away from said body portion thereby giving added carrying capacity to said main compartment and to said sub-compartment.

13. A luggage case having front and back ends, and a cover at least attached to said front end, said cover comprising:

an outer material panel means being substantially coextensive with said front cover, said outer panel means having a center section and an outer peripheral section with an outer peripheral edge and disposed around said center section, said outer panel means further including first welt means disposed inwardly of said outer peripheral edge of said outer peripheral section and around said center section and second welt means including said outer peripheral edge of said outer peripheral section and concentrically arranged relative to and outwardly from said first welt means and cooperating with said first welt means to form a framework for said panel means of said cover, and said panel means of said cover further comprising reinforcement means disposed along said outer peripheral section between said first welt means and said second welt means to space and maintain said first welt means and said second welt means apart relative to each other and to cooperative with said first welt means and said second welt means to add rigidity to said panel means of said cover, and said reinforcement means being included in said first welt means and in said second welt means.

14. A luggage case according to claim 13, wherein said cover further comprises a sheet of lining material which is substantially coextensive with said cover and said panel means, and which has an outer peripheral edge connected to said second welt means.

15. A luggage case according to claim 13, wherein said cover is generally a rectangular configuration with corners, and said reinforcement means is located along each said corner of said panel means.

16. A luggage case according to claim 13, wherein said panel means is in a dome configuration with said center section being relatively flat and protruding in an outwardly fashion away from said second welt means, and with said outer peripheral section being in a relatively tapered fashion and extending outwardly from said second welt means to said first welt means and said center section.

17. A luggage case according to claim 13, wherein said material of said center section and said outer peripheral section consists of a durable, flexible textured material, and wherein said material of said center section is of the same type of material as said material of said outer peripheral section.

18. A luggage case having front and back ends and a cover at least attached to said front end, said cover comprising:

an outer material panel means being substantially coextensive with said front cover, said outer panel means having a center section and an outer peripheral section with an outer peripheral edge and disposed around said center section, said outer panel means further including first welt means disposed inwardly of siad outer peripheral edge of said outer peripheral section and around said center section and second welt means including said outer peripheral edge of said outer peripheral section and concentrically arranged relative to and outwardly from said first welt means and cooperating with said first welt means to form a framework for said panel means of said cover, said panel means of said cover further comprising reinforcement means disposed along said outer peripheral section between said first welt means and said second welt means to space and maintain said first welt means and said second welt means apart relative to each other and to cooperate with said first welt means and said second welt means to add rigidity to said panel means of said cover, said cover being generally a rectangular configuration with corners, and said reinforcement means being located along each said corner of said panel means, and said reinforcement means consisting of a plurality of pieces of material, each said piece of material being located on an outer surface of said outer peripheral section.

19. A luggage case according to claim 18, wherein said first welt means and said second welt means each has an inner wire and an outer material covering, and wherein said material covering of said first and second welt means is of the same type of material as said material of said reinforcement means.

20. A luggage case according to claim 18, wherein said cover further comprises a sheet of lining material which is substantially coextensive with said cover and said panel means, and which has an outer peripheral edge connected to said second welt means.

21. A luggage case according to claim 18, wherein said panel means is in a dome configuration with said center section being relatively flat and protruding in an outwardly fashion away from said second welt means, and with said outer peripheral section being in an relatively tapered fashion and extending outwardly from said second welt means to said first welt means and said center section.

22. A luggage case according to claim 18, wherein said material of said center section and said outer peripheral section consists of a durable, flexible textured material, and wherein said material of said center section is of the same type of material as said material of said outer peripheral section.

23. A luggage case having front and back ends, and a front cover and a back cover attached to said front and back ends, respectively, said front and back cover each comprising:

an outer material panel means being substantially coextensive with said cover, said outer panel means including a center section having an outer peripheral edge, and an outer peripheral section having an outer peripheral edge and an inner peripheral edge and arranged around said center section, and first welt means disposed around said center section and connecting said outer peripheral edge of said center section and said inner peripheral edge of said outer peripheral section together to form said panel means of said cover, and second welt means including said outer peripheral edge of said outer peripheral section and concentrically arranged relative to and outwardly from said first welt means and cooperating with said first welt means to form a framework for said panel means, and said case further comprising a body portion having side walls and a dividing wall in said sidewalls to form a main compartment and a sub-compartment adjacent to said main compartment, and wherein said front cover is a part of and provides access to said main compartment, and said back cover is a part of and provides access to said sub-compartment.

24. A luggage case according to claim 23, wherein said center section of said panel means of said front cover and said center section of said panel means of said back cover are extended away from said body portion thereby giving added carrying capacity to said main compartment and to said sub-compartment.

25. A luggage case having front and back ends and a front cover at least on said front end, said front cover comprising:

a sheet of lining material which is substantially coextensive with said front cover, and having an outer peripheral edge, an outer material panel means being substantially coextensive with said lining material, said outer panel means including a center section having an outer peripheral edge, and a gusset means having an outer peripheral edge and an inner peripheral edge and arranged around said center section, and first welt means disposed around said center section and connecting said outer peripheral edge of said center section and said inner peripheral edge of said gusset means together to form said panel means of said front cover, second welt means including said outer peripheral edge of said gusset means and said outer peripheral edge of said lining material and concentrically arranged relative to and outwardly from said first welt means and cooperating with said first welt means to form a framework for said panel means, said gusset means being attached in a tapering fashion to said first welt means such that said center section and said first welt means extends outwardly from said second welt means, said panel means of said cover further comprising reinforcement means disposed along said gusset means between said first welt means and said second welt means to space and maintain said first welt means and said second welt means apart relative to each other and to cooperate with said first welt means and said second welt means to add rigidity to said panel means of said front cover, said reinforcement means being included in said first welt means and in said second welt means.

26. A luggage case according to claim 25, wherein said cover is generally a rectangular configuration with corners, and said reinforcement means is located along each said corner of said panel means.

27. A luggage case according to claim 25, wherein said reinforcement means consists of a plurality of pieces of material, each said piece of material being located on an outer surface of said gusset means.

28. A luggage case according to claim 27, wherein said first welt means and said second welt means each has an inner wire and an outer material covering, and wherein said material covering of said first and second welt means is of the same type of material as said material of said reinforcement means.

29. A luggage case according to claim 25, wherein said material of said center section and said gusset means consists of a durable, flexible textured material, and wherein said material of said center section is of the same type of material as said material of said gusset means.

30. A luggage case according to claim 25, wherein said case further comprises a body portion having sidewalls and a dividing wall in said sidewalls to form a main compartment and a sub-compartment adjacent to said main compartment, and wherein said front cover provides added carrying capacity to said main compartment, and a back cover on said back end, said back cover comprising:

a sheet of lining material which is substantially coextensive with said back cover, and having an outer peripheral edge, an outer panel means being substantially coextensive with said lining material, said outer panel means including a center section having an outer peripheral edge, and a gusset means having an outer peripheral edge and an inner peripheral edge and arranged around said center section, and first welt means disposed around said center section and connecting said outer peripheral edge of said center section and said inner peripheral edge of said gusset means together to form said panel means of said back cover, second welt means including said outer peripheral edge of said gusset means and said outer peripheral edge of said lining material and concentrically arranged relative to and outwardly from said first welt means and cooperating with said first welt means to form a framework for said panel means, said gusset means being attached in a tapering fashion to said first welt means such that said center section and said first welt means extends outwardly from said second welt means, said panel means of said cover further comprising reinforcement means disposed along said gusset means between said first welt means and said second welt means to space and maintain said first welt means and said second welt means apart relative to each other and to cooperate with said first welt means and said second welt means to add rigidity to said panel means of said back cover, said reinforcement means being included in said first welt means and in said second welt means, and wherein said back cover provides added carrying capacity to said sub-compartment.

* * * * *